United States Patent [19]

Mancel et al.

[11] Patent Number: 5,026,453

[45] **Date of Patent: * Jun. 25, 1991**

[54] APPARATUS FOR ORNAMENT PRODUCTION

[75] Inventors: James D. Mancel, Brampton; Olaf B. Raiskums, Milton, both of Canada

[73] Assignee: Rainbow Star Licensing, S.A., Freibourg, Switzerland

[ * ] Notice: The portion of the term of this patent subsequent to Apr. 28, 2004 has been disclaimed.

[21] Appl. No.: 338,235

[22] Filed: Apr. 14, 1989

Related U.S. Application Data

[60] Continuation of Ser. No. 188,891, Apr. 29, 1988, Pat. No. 4,855,009, which is a division of Ser. No. 318, Dec. 29, 1986, Pat. No. 4,849,042, which is a division of Ser. No. 772,576, Sep. 4, 1985, Pat. No. 4,661,197.

[51] Int. Cl.[5] ..... B31F 1/00

[52] U.S. Cl. ..... 156/443; 156/217; 156/227; 156/481; 493/955; 428/4; 223/46

[58] Field of Search ..... 156/217, 218, 227, 285, 156/443, 446, 447, 448, 481; 493/955, 454; 428/4, 24, 26; 223/46; 434/36, 81

[56] References Cited

U.S. PATENT DOCUMENTS

| | | | |
|---|---|---|---|
| D. 295,731 | 5/1988 | Mancel . | |
| 1,188,088 | 6/1916 | Malstrom | 156/61 |
| 1,400,691 | 12/1921 | Malstrom | 428/26 |
| 1,730,628 | 10/1929 | Rogers | 428/26 |
| 1,861,604 | 6/1932 | Loring . | |
| 2,578,329 | 12/1951 | Von Hofe | 156/443 X |
| 2,806,313 | 9/1957 | James . | |
| 2,910,794 | 11/1959 | Lockridge | 428/4 |
| 3,041,765 | 7/1962 | Paar | 428/4 X |
| 3,112,240 | 11/1963 | Kravig et al. . | |
| 3,139,225 | 6/1964 | Rector | 223/46 |
| 3,157,096 | 11/1964 | Schmidt | 156/218 X |
| 3,520,759 | 7/1970 | Agena et al. . | |
| 3,922,407 | 11/1975 | Nimmo, Jr. et al. | 223/46 X |
| 4,291,496 | 9/1981 | Click | 428/4 X |
| 4,478,670 | 10/1984 | Heyse et al. | 156/443 X |
| 4,661,197 | 4/1987 | Mancel et al. . | |
| 4,840,689 | 6/1989 | Raiskums et al. | 156/443 X |
| 4,855,009 | 8/1989 | Mancel et al. | 156/443 |

FOREIGN PATENT DOCUMENTS

| | | | |
|---|---|---|---|
| 298157 | 3/1917 | Fed. Rep. of Germany . | |
| 329597 | 11/1920 | Fed. Rep. of Germany . | |
| 347189 | 1/1922 | Fed. Rep. of Germany . | |
| 652857 | 10/1935 | Fed. Rep. of Germany . | |
| 0412512 | 6/1934 | United Kingdom | 493/955 |

OTHER PUBLICATIONS

"Werkbuch fur die Weihnachtszeit" by Gert Lindner, 1966, Gütersloher Verlagshaus Gerd Mohn, Gütersloh.

*Primary Examiner*—John J. Gallagher
*Assistant Examiner*—Jeff H. Aftergut
*Attorney, Agent, or Firm*—Rosen, Dainow & Jacobs

[57] ABSTRACT

A method and apparatus is disclosed for producing an ornament for gift wrapping purposes and the like. The ornament has a basic member with a plurality of radially disposed conical elements, and these basic members may be combined to produce spheroidal or hemispheroidal ornaments having a plurality of radial cones or spikes. In the method, a flat circular blank is formed with a plurality of radially disposed leaves. The leaves are wrapped around a conical form and adhesively secured to form one of the basic members. The apparatus includes a winder for wrapping the leaves around the conical form and positioning means for holding the blank and locating each leaf on the form to be wrapped into a conical element by the winder.

21 Claims, 4 Drawing Sheets

10
14
15
15
16
18
20
22
24
26
28
30
32
34
36
38
40
42
44
44
44
46
46
48
50
52
54
54
56
56
58
60
62
62
64
66
68
70

APPARATUS FOR ORNAMENT PRODUCTION

This is a continuation of application Ser. No. 188,891, filed Apr. 29, 1988, now U.S. Pat. No. 4,855,009, which is a division of application Ser. No. 000,318, filed Dec. 29, 1986, now U.S. Pat. No. 4,849,042, which is a division of application Ser. No. 772,576, filed Sept. 4, 1985, now U.S. Pat. No. 4,661,197.

This invention relates to a method and apparatus for producing ornaments or decorations which may be used for wrapping gifts in a manner similar to ribbon-type bows or for any other purposes.

The most common type of ornament used in the past for gift wrapping is the ribbon bow. Such bows can be hand made or machine made, and they can either be in the form of a random collection of ribbon loops and ribbon strands, or they can be made with uniform or symmetrical ribbon loops and strands. Either type is esthetically pleasing, but if the objective is the uniform type, it is generally considered to be desirable to have a regular pattern or a symmetrical shape with the various elements of the ornament made in predetermined uniform sizes and shapes.

A difficulty with the prior art bow type ornaments is that they are too commonplace, especially the machine bows, since they tend to be so perfectly made that they look cheap.

It is an object of the present invention to overcome these disadvantages by producing a novel ornament having conically formed elements.

According to one aspect of the invention, there is provided a method of producing an ornament having a plurality of radially arranged conical elements. The method comprises the steps of forming a planar, circular blank of flexible material having a plurality of flat radially disposed leaves. A conical form is provided and each of said leaves is wrapped around the form to produce a disc with a conical element on each leaf. Also, adjacent surfaces of each leaf are adhesively attached while on the form to retain same in the conical configuration upon separation of the form.

According to another aspect of the invention, there is provided apparatus for producing a disk with a plurality of circumferentially arranged conical elements from a planar, circular blank having a pluraliy of flat radially disposed leaves. The apparatus comprises a conical form having a longitudinal axis, and positioning means mounted adjacent to the form and being adapted to hold the blank with one leaf thereof in contact with the form. A winder is rotatably mounted about the axis of the form for wrapping the leaf around the form to form a conical element. Means is provided for applying adhesive to adjacent surfaces of the leaf to retain the formed conical element in the conical configuration. Means is provided for separating the form from the conical element, and the positioning means includes means for rotating the blank relative to the form to position another leaf to be formed into a conical element.

Preferred embodiments of the invention will now be described, by way of example with reference to the accompanying drawings, in which.

Figure 4:
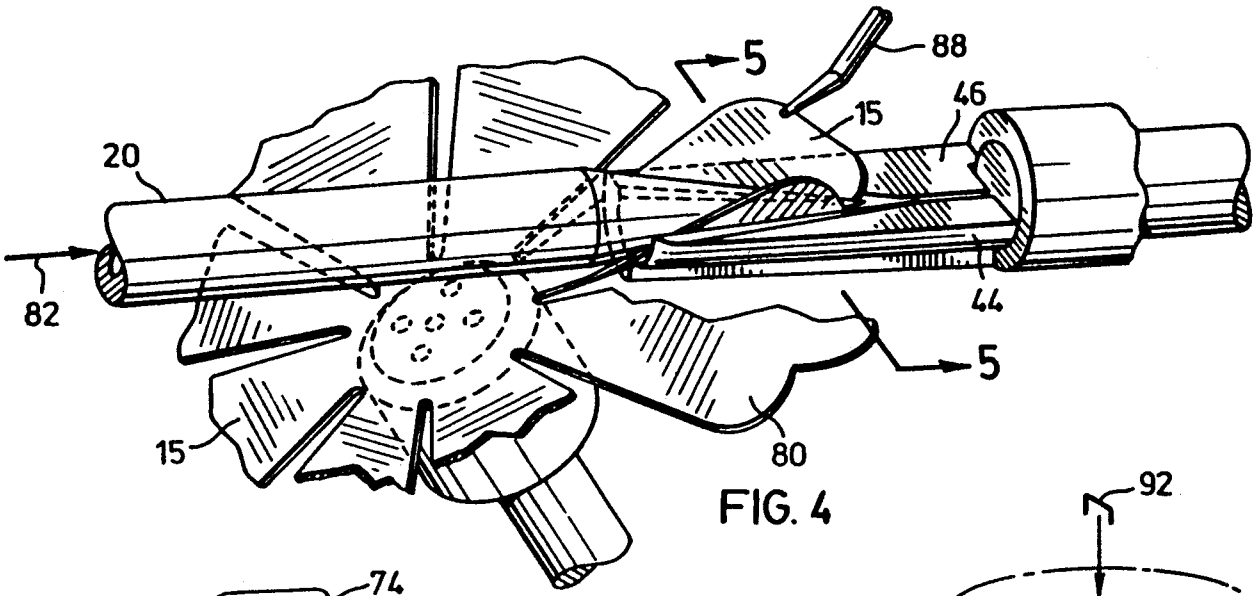
FIG. 4 is an enlarged perspective view of the preferred embodiment showing a blank in position with one leaf ready to be wrapped around the conical form to form a conical element.
Figure 7:
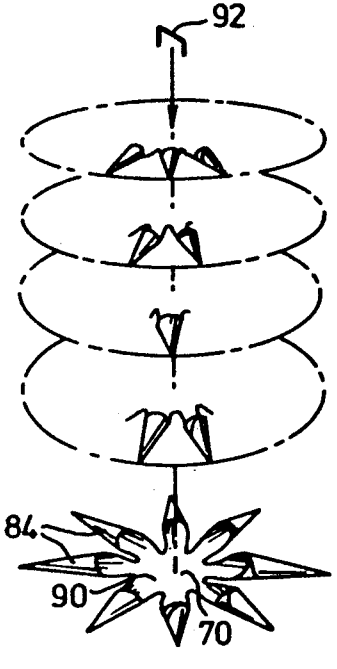
Figure 6:
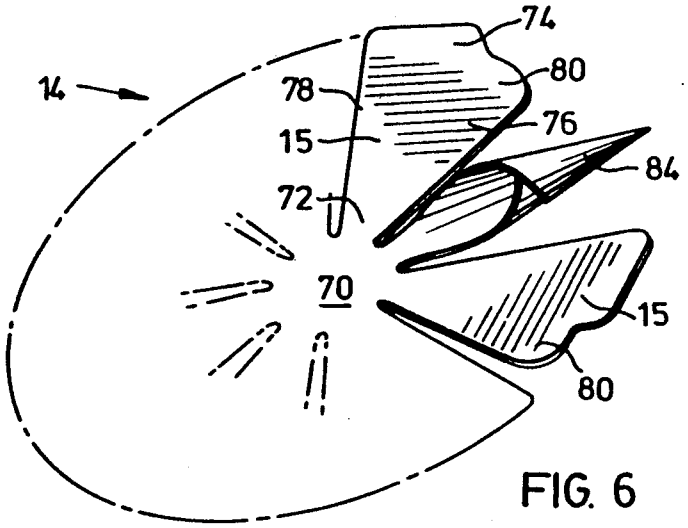
Figure 8:
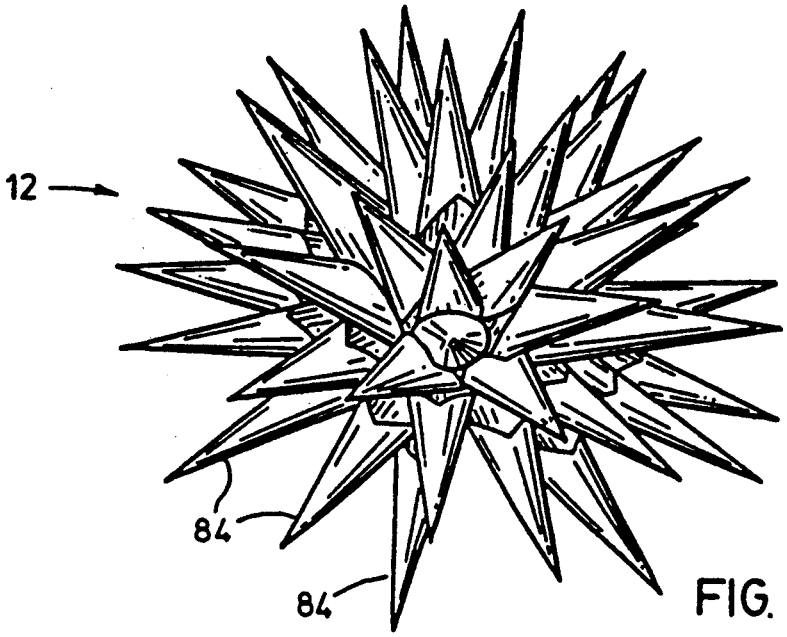
Figure 9:
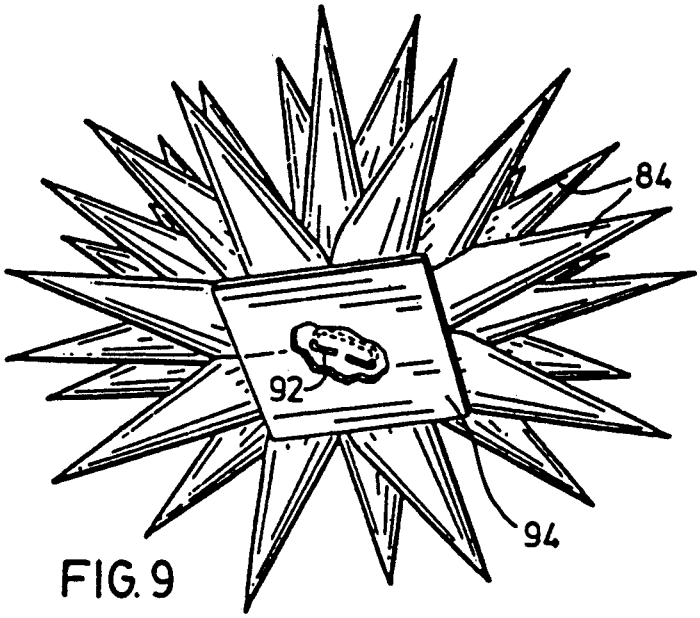
Figure 10:
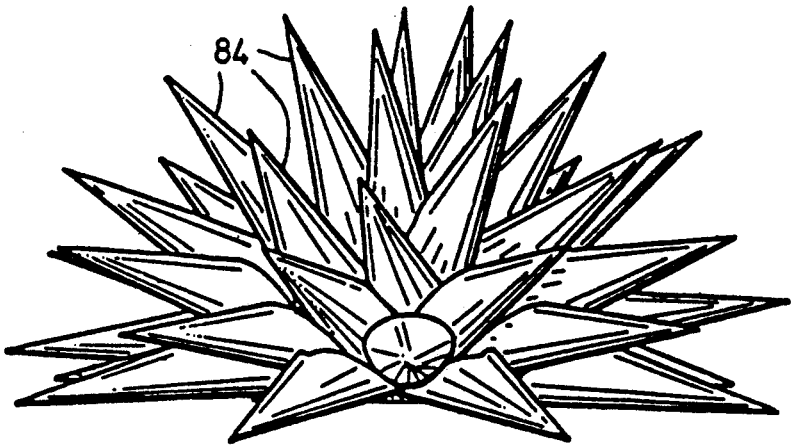

FIGS. 5*a* to 5*d* are sectional views taken along lines 5—5 of FIG. 4 showing sequential stages of a leaf being wrapped around the conical form;

FIG. 6 is a perspecive view of a blank after one leaf has been formed with a conical element;

FIG. 7 is an exploded perspective view showing a plurality of disks prior to being assembled into an ornament as shown in FIGS. 8, 9 and 10;

FIG. 8 is a perspective view looking from above of an ornament produced by the method of the present invention;

FIG. 9 is a pespective view of the ornament shown in FIG. 8 but viewed from below; and FIG. 10 is an elevational view of the ornament shown in FIGS. 8 and 9.

Figures 1, 2, 3:
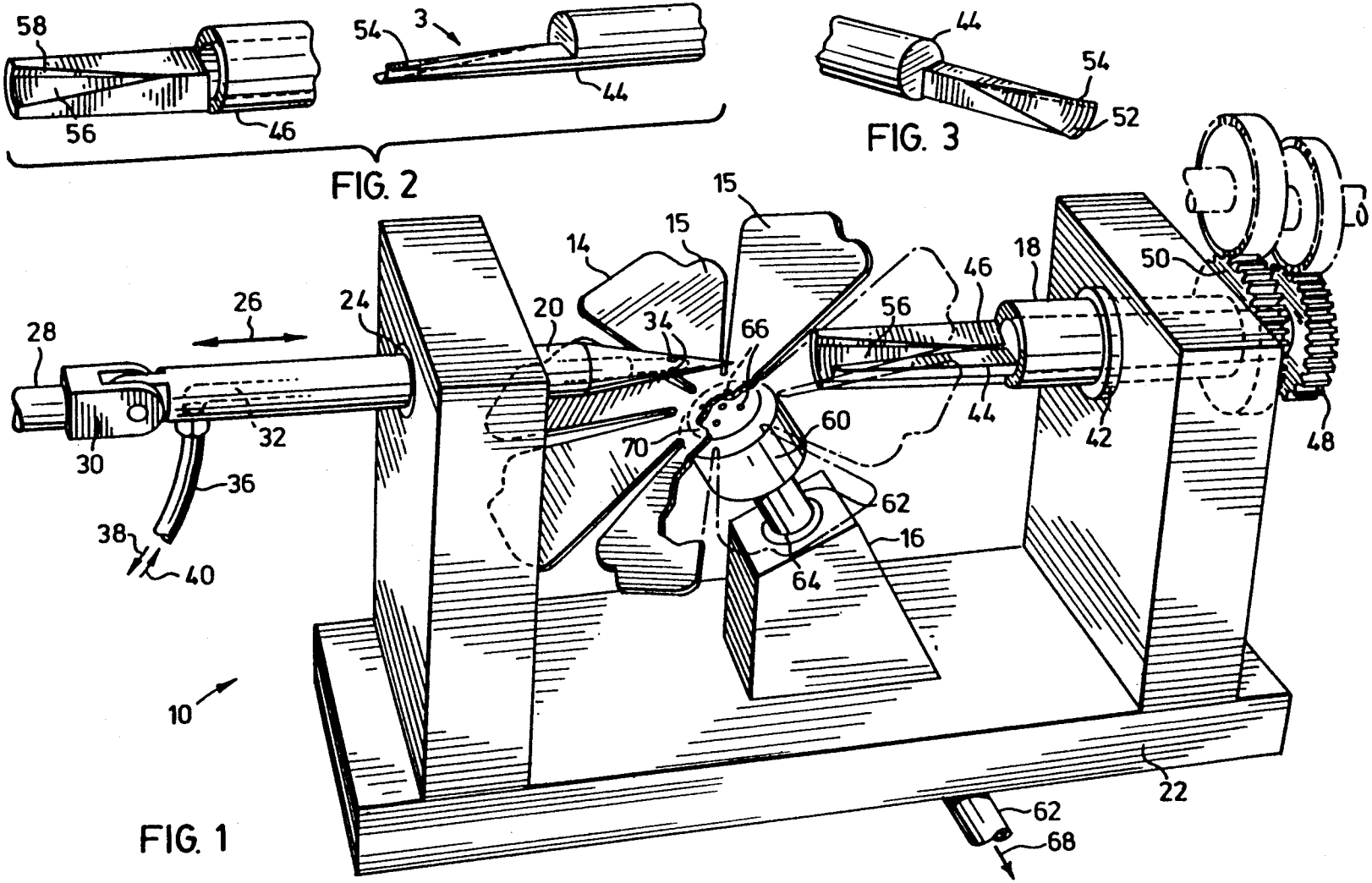
FIG. 1 is a diagrammatic perspective view of a preferred embodiment of the apparatus of the present invention.
FIG. 2 is an exploded perspecive view of the wrapping elements of the winder of the embodiment shown in FIG. 1.
FIG. 3 is a perspective view of the first wrapping element viewed in the direction of arrow 3 of FIG. 2.

Referring to the drawings, in FIG. 1 a preferred embodiment of an ornament winding apparatus is shown diagrammatically and is generally indicated by reference numeral 10. FIGS. 2 and 3 show details of the wrapping elements of winding apparatus 10. FIGS. 4 to 7 inclusive illustrate the operation of the winding apparatus, and FIGS. 8 to 10 show a typical ornament 12 which may be produced using the method and apparatus of the present invention.

As mentioned above, FIG. 1 is a diagrammatic representation of winding apparatus 10, and it shows a blank 14 retained in position by a fixed positioning device 16. Blank 14 has a plurality of flat radially disposed leaves 15, some of which are only shown in phantom for the purposes of illustration. A winder assembly 18 and a conical form 20 are shown mounted in a frame 22. In a production version of winding apparatus 10, there would be multiple sets of winder assemblies 18 and conical forms 20 and multiple positioning devices 16 that move between the sets of winder assembly 18 and conical form 20 with the blank 14 being rotated and indexed to operate successively on each leaf 15 of blank 14. However, for the purposes of illustration, winding apparatus 10 has been shown as a single unit for the purposes of simplification in the present specification. In any event, the apparatus shown in FIG. 1 would work perfectly well and it is not necessary to have multiple sets of the apparatus for the purposes of the present invention.

Referring in particular to FIGS. 1 to 3, the conical form 20 is longitudinally slideably mounted in a bearing 24 in frame 22, so that conical form 20 moves in a reciprocating motion as indicated by arrow 26. Conical form 20 is connected to an actuator indicated by reference numeral 28 through a conventional clevis 30, so that the actuator 28 reciprocates conical form 20 into and out of engagement with winder assembly 18. Conical form 20 has a longitudinal internal passage 32 communicating with openings 34 adjacent to the distal end of form 20. A flexible supply hose 36 is connected to conical form 20 to communicate with internal passage 32 and vacuum or air pressure as required is supplied to internal passage 32, as indicated by respective arrows 38, 40. The vacuum is supplied to conical form 20 to help the leaves 15 adhere to the form in operation of the apparatus, and pressure is applied to the internal passage through tube 36 of conical form 20 to release the leaves 15 from the form after they have been formed into conical elements as will be described further below.

The winder assembly 18 is rotatably mounted in a bearing 42 in frame 22, and suitable retaining rings (not shown) are provided to prevent longitudinal movement of the members of the winder assembly 18. Winder assembly 18 includes a first internal wrapping element 44 and a second outer concentric wrapping element 46, and wrapping elements 44, 46 rotate relative to each other about a common axis. This axis is a coincident with the longitudinal axis of conical form 20 in the preferred embodiment but it does not have to be as discussed further below. First and second wrapping elements 44, 46 are driven by respective gear trains 48, 50, but second wrapping element 46 could just be frictionally mounted in frame 22 so that it is driven by the first wrapping element 44 as discussed below as well.

Referring in particular to FIGS. 2 and 3, first wrapping element 44 has a conical bed 52 which mates with the conical end portion of conical form 20 when the two are brought together. Consequently, conical bed 52 is in a lower quadrant of first wrapping element 44 as shown in the drawings. A longitudinal knife edge 54 is formed along one side of conical bed 52, the purpose of which will be described below.

Second wrapping element 46 also has a conical bed 56 in a lower quadrant thereof which mates with the conical end portion of conical form 20. Conical bed 56 has one bevelled longitudinal edge 58 which mates with or accommodates the knife edge 54 of first wrapping element 44 when the two wrapping elements are rotated together so that the knife edge 54 fits into the bevelled edge 58. When the two wrapping elements 44, 46 are positioned as shown in FIG. 1, the two conical beds 52, 56 are in registration to form a combined conical bed to receive a leaf 15 of the blank 14.

The positioning device 16 includes a vacuum head 60 mounted on a hollow shaft 62 retained in a bearing 64, so that vacuum head 60 is rotatably mounted in frame 22. The vacuum head 60 has a plurality of openings 66 in the upper surface thereof in communication with the hollow shaft 62, so that when vacuum is applied to hollow shaft 62 as indicated by arrow 68, a suction is applied to the central portion 70 of blank 14 to retain the blank in position with one leaf 15 positoned over the conical beds of the wrapping elements 44, 46. A suitable drive and indexing mechanism (not shown) is connected to vacuum head 60 to rotate the blank and position each leaf 15 seriatim over the conical beds of the wrapping elements. Vacuum head 60 is orientated obliquely relative to the axis of conical form 20 and winder assembly 18, so that as blank 14 is rotated by vacuum head 60 with conical form 20 separated from winder assembly 18 as shown in FIG. 1, the leaves 15 can pass above wrapping elements 44, 46 to be positioned over the conical beds 52, 56. Also, the longitudinal central axis of vacuum head 60 intersects with the longitudinal axis of conical form 20 and winder assembly 18 in the preferred embodiment.

The operation of winding apparatus 10 and the method of producing an ornament using this apparatus according to the present invention will now be described with particular reference to FIGS. 4 to 6. Firstly a blank 14 is formed and this is a planar, circular blank of flexible material such as paper or plastic and it has a plurality of flat radially disposed leaves 15. In the preferred embodiment, leaves 15 are spaced apart slightly and are conical in plan view, each having a narrow neck portion 72 adjacent to the central portion 70 of the blank. Each leaf 15 also has a wider distal end portion 74 and respective first and second side portions 76, 78. First side portion 76 has a tab 80, the purpose of which will be described further below.

Blank 14 is then placed on vacuum head 60, and the vacuum head is rotated until one leaf 15 is positioned over the conical beds, 52, 56 of winder assembly 18. Conical form 20 is then advanced in the direction of arrow 82 in FIG. 4 until the conical end portion of conical form 20 engages leaf 15 and presses same into the conical beds of wrapping elements 44, 46. Vacuum is then applied through supply hose 36 and leaf 15 is wrapped around conical form 20 to produce a conical element 84 as shown in FIG. 6.

Figure 5A:
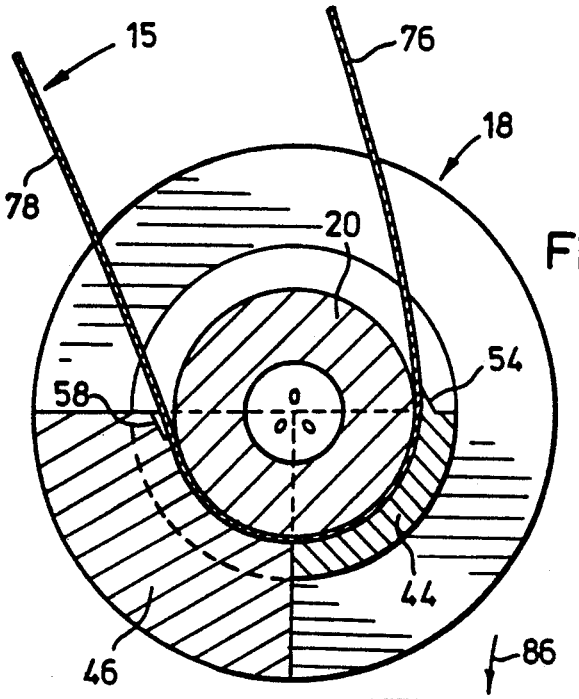
Figure 5B:
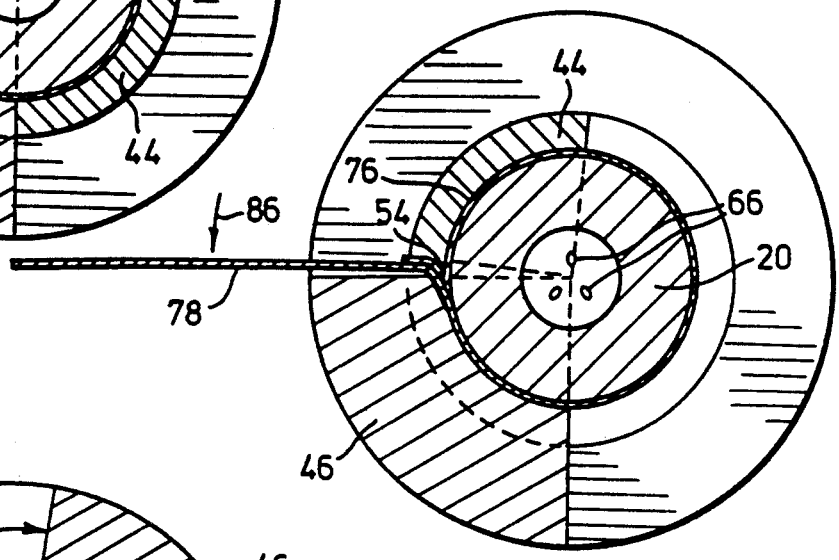
Figure 5C:
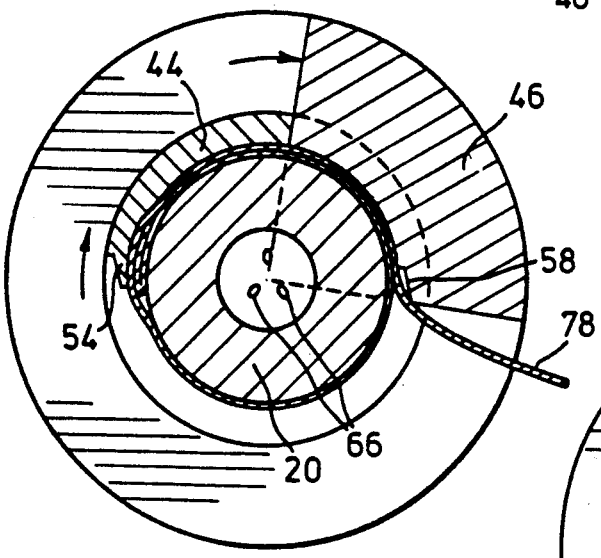
Figure 5D:
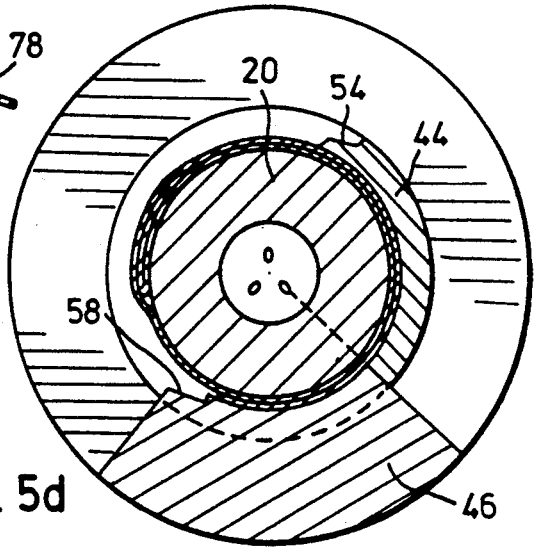

The wrapping of a leaf 15 into a conical element 84 is best illustrated by FIGS. 5*a* to 5*d*. FIG. 5*a* shows winder assembly 18 in the position shown in FIGS. 1 and 4 with wrapping elements 44, 46 in the starting positon. Wrapping element 44 is then rotated counterclockwise as seen in FIG. 5 by gear train 48 causing the first side portion 76 of leaf 15 to be wrapped around conical form 20. Wrapping element 44 is continued to be rotated to the position shown in FIG. 5*b* whereupon knife edge 54 tucks or crimps the tab 80 of first side portion 76 under the second side portion 78. This helps retain the first side portion wrapped on conical form 20 as the wrapping operation continues. Also, the vacuum applied to conical form 20 through openings 66 creates a suction to help hold the first side portion 76 in position. The direction of rotation of first wrapping element 44 is then reversed and wrapping element 44 is rotated clockwise until it engages second wrapping element 46. Both wrapping elements 44, 46 then continue to rotate clockwise as indicated in FIG. 5*c* causing second side portion 78 to be wrapped around conical form 20 overlapping the first side portion 76 as illustrated in FIG. 5*c*. Wrapping elements 44, 46 then continue the clockwise rotation as illustrated in FIG. 5*d* to complete conical element 84, and the rotation continues further until the wrapping elements 44, 46 again end up in the starting position shown in FIGS. 1 and 4.

When the wrapping elements 44, 46 are in the position shown in FIG. 5*b* and just prior to second side portion 78 being wrapped around first side portion 78 a shot of adhesive is applied to second side portion 76 in the location indicated by arrow 86 in FIG. 5*b*. This adhesive is applied by an adhesive spray or applicator 88 positioned as shown in FIG. 4. Any suitable adhesive may be used depending upon the material used for blank 14.

After the conical element 84 has been formed on conical form 20 as in FIG. 5*d*, the conical form 20 is retracted or separated from the conical element. To facilitate this separation, the vacuum previously applied to conical form 20 through supply hose 36 is discontinued and replaced by positive air pressure to help release the conical element from conical form 20. Vacuum head 60 is then rotated to bring the next leaf 15 into position and the procedure is repeated to make a second conical element 84. The method is continued until a disk 90 is produced as shown in FIG. 7 with a conical element 84 formed on each leaf.

Disk 90 having a plurality of radially arranged conical elements may itself be used as a decoration or ornament, or a plurality of disks 90 may be combined to form an ornament 12 as shown in FIGS. 8 to 10. Ornament 12 is made by stacking a plurality, such as seven, disks 90 in a vertical arrangement as shown in FIG. 7 and compressing the centre portions of the stack of disks and connecting them together with a fastener such as a staple 92. If desired, a self-adhesive backing 94 can be placed beneath the stack of disks 90 prior to stapling them together so that ornament 12 is provided with an adhesive base as shown in FIG. 9 for attaching the ornament to another object. The ornament shown in FIGS. 8 to 10 is produced by stacking the disks 90 as in FIG. 7 such that the conical elements 84 of alternating disks are staggered as shown in FIG. 7. This produces an ornament 12 which is symmetrical with evenly spaced radially orientated projecting conical elements 84.

It will be appreciated that leaves 15 are centered on the conical form 20 prior to being wrapped into a conical element 84 in the preferred embodiment, and that the first and second side portions 76, 78 are wrapped transversely around conical form 20. The side portions 76, 78 are wrapped symmetrically around conical form 20, so that the axes of the conical elements are radially orientated in disk 90. The conical elements are also radially orientated in the ornament shown in FIGS. 8 to 10. If desired, two of the ornaments shown in FIGS. 8 to 10 can be put back to back to produce a spheroidal ornament rather than an hemispheroidal ornament as shown in FIGS. 8 to 10. This can also be done in one step by stacking the disks 90 appropriately as in FIG. 7 prior to compressing the centre portions and attaching the disks together.

Having described preferred embodiments of the invention, it will be appreciated that various modifications may be made to the apparatus and methods described. For example, the number of leaves in each blank can be varied as well as the shape of each leaf. Different numbers of disks 90 can be used to form ornaments and they can be coupled together in different ways as will be appreciated by persons skilled in the art. Further, conical element 20 could be positioned differently so that the longitudinal axis of the conical element is not coincident with the axis of the winder assembly 18. This would result in conical elements 84 being in an askew arrangement which may be desirable to produce different looking ornaments. Also as mentioned above, it is not necessary to independently drive the second wrapping element 46. As will be apparent from FIGS. 5*a* to 5*d*, if second wrapping element 46 is rotatably but frictionally held in frame 22, the first wrapping element 44 will engage and drive the second wrapping element 46 by itself. However, the independent drive means for each of the wrapping elements, 44, 46 is preferred. Finally, it is not necessary to have the first side portion 76 crimped or tucked under the second side portion 78 of leaf 15 by knife edge 54, because the vacuum or suction applied to conical element 20 should be sufficient to retain the first side portion in position while the second side portion 78 is wrapped around it to complete the conical element 84.

From the above, it will be appreciated that the method and apparatus of the present invention produces a unique and esthetically pleasing ornament made of a plurality of uniformly shaped conical elements that may be combined in various arrangements as desired.

The embodiments of the invention in which an exclusive property or privilege is claimed are defined as follows:

1. Apparatus for producing, for use in an ornament, at least one ornament element having a three dimensional shape from a bendable blank having at least one leaf, said apparatus comprising:

a form having a three dimensional shape corresponding to said three-dimensional shape of said ornament element;

means for releasably holding said at least one leaf against said form;

a winding surface having a shape at least in part conforming to said shape of said form;

means for relatively arcuately moving said form and said winding surface while said leaf is between said winding surface and said form and held against said form by said holding means to wind said leaf about said form;

means for treating said leaf such that said leaf after being at least partially wound on said form retains a wound configuration when said leaf is separated from said form as an ornament element.

2. The apparatus of claim 1 wherein said form and said winding surface are relatively movable to relatively position said form and said winding surface in a first relative position in which said form and said winding surface are closely adjacent each other such that they may cooperate upon relative arcuate movement between them with said leaf held against said form by said holding means to wind said leaf about said form, and a second relative position in which said form and said winding surface are spaced such that a wound leaf may be separated from said form and another leaf may be releasably held against said form;

said apparatus including means for relatively moving said form and said winding surface between said first position and said second position.

3. The apparatus of claim 1 wherein treating means is disposed to treat said leaf while a leaf is at least partially wound on said form.

4. The apparatus of claim 3 wherein a treating means comprises an adhesive applicator positioned to apply adhesive to a surface of said leaf partially wound said form.

5. The apparatus of claim 1 wherein said three dimensional leaf shape is conical and said form has a corresponding conical shape.

6. The apparatus of claim 5 wherein said winding surface comprises a curved surface contoured to generally correspond to the curvature of a segment of said conical shape of said form.

7. The apparatus of claim 6 wherein said curved surface is conical.

8. The apparatus of claim 1 wherein said form is stationary and said arcuately moving means moves said winding surface relative to said form.

9. The apparatus of claim 1 wherein said holding means comprises a passage in said form opening at a location on said form covered by said leaf wound on said form and means for selectively applying a vacuum to said passage.

10. The apparatus of claim 1 including means for separating said wound leaf from said form.

11. The apparatus of claim 10 wherein said separating means comprises a passage in said form opening at a location on said form covered by said leaf wound on said form and means for selectively applying positive pressure to said passage.

12. The apparatus of claim 1 including means for attaching a plurality of ornament elements to form said ornament.

13. Apparatus for producing, for use in an ornament, at least one ornament element having a conical shape from a bendable blank having at least one leaf, said apparatus comprising:

a form having a conical shape corresponding to said conical shape of said ornament element;

means for releasably holding said at least one leaf against said form;

a winding surface having a conical portion conforming to a portion of said conical form;

means for relatively moving said form and said winding surface while a leaf is held against said form by said holding means to wind said leaf about said form;

means for treating said leaf such that said leaf after being at least partially wound on said form retains a wound configuration when said leaf is removed from said form as an ornament element.

14. The apparatus of claim 13 wherein said form and said winding surface are relatively movable to relatively position said form and said winding surface in a first relative position in which said form and said winding surface are closely adjacent each other such that they may cooperate upon relative arcuate movement between them with said leaf held against said form by said holding means to wind said leaf about said form, and a second relative position in which said form and said winding surface are spaced such that a wound leaf may be separated from said form and another leaf may be releasably held against said form;

said apparatus including means for relatively moving said form and said winding means between said first position and said second position.

15. The apparatus of claim 13 wherein said treating means is disposed to treat said leaf while said leaf is at least partially wound on said form.

16. The apparatus of claim 13 wherein said treating means comprises an adhesive applicator positioned to apply adhesive to a surface of said leaf partially wound on said form.

17. The apparatus of claim 13 wherein said form is stationary and said moving means rotates said winding means relative to said form.

18. The apparatus of claim 13 wherein said holding means comprises a passage in said form opening at a location on said form covered by said leaf wound on said form and means for selectively applying a vacuum to said passage.

19. The apparatus of claim 13 including means for separating said wound leaf from said form.

20. The apparatus of claim 19 wherein said separating means comprises a passage in said form opening at a location on said form covered by said leaf wound on said form and means for selectively applying positive pressure to said passage.

21. The apparatus of claim 13 including means for attaching ornament elements to form said ornament.

* * * * *